US005659859A

United States Patent [19]

Kikuta et al.

[11] Patent Number: 5,659,859

[45] Date of Patent: Aug. 19, 1997

[54] DEVELOPER AGITATING/CONVEYING DEVICE

[75] Inventors: Shinji Kikuta; Toshio Nishino; Tsutomu Nagata; Motoyuki Fukuda; Mitsuhiro Kashihara; Akihiko Ichiba, all of Osaka, Japan

[73] Assignee: Mita Industrial Co., Ltd., Osaka, Japan

[21] Appl. No.: 467,970

[22] Filed: Jun. 6, 1995

[30] Foreign Application Priority Data

Jun. 21, 1994 [JP] Japan ..... 6-138487
Jun. 21, 1994 [JP] Japan ..... 6-139013

[51] Int. Cl.[6] ..... G03G 15/08

[52] U.S. Cl. ..... 399/256

[58] Field of Search ..... 355/245, 246, 355/251, 253, 260; 118/653; 222/DIG. 1; 399/254–256

[56] References Cited

U.S. PATENT DOCUMENTS 4,864,349 9/1989 Ito ..... 355/253
5,122,834 6/1992 Okamoto et al. ..... 355/246 X
5,204,721 4/1993 Sharpe ..... 355/260
5,495,320 2/1996 Araki et al. ..... 355/245
5,510,882 4/1996 Kikuta et al. ..... 355/245

*Primary Examiner*—William J. Royer
*Attorney, Agent, or Firm*—Antonelli, Terry, Stout & Kraus, LLP.

[57] ABSTRACT

A developer agitating/conveying device having at least one partition wall disposed within a housing with a developer transfer port at the central portion thereof; a first agitating/conveying member disposed along the partition wall on one side of the partition wall for conveying the developer from the opposite end portions toward the central portion thereof, the first agitating/conveying member having a first helical blade and a second helical blade; and a second agitating/conveying member disposed along the partition wall on the other side of the partition wall for conveying the developer from the central portion toward the opposite end portions thereof, the second agitating/conveying member having a first helical blade and a second helical blade. The first and second helical blades provided on the first agitating/conveying member for helically wound in directions opposite to each other and are constructed such that their respective inner end half pitches overlap with a phase angle of 180 degrees relative to each other so as not to intersect each other.

10 Claims, 9 Drawing Sheets

DEVELOPER AGITATING/CONVEYING DEVICE

FIELD OF THE INVENTION

This invention relates to a developer agitating/conveying device mounted in a latent electrostatic image developing device for use in developing a latent electrostatic image to a toner image in image forming apparatuses such as electrostatic copying machines and electrostatic printing machines.

DESCRIPTION OF THE PRIOR ART

As is well known, a latent electrostatic image developing device of the type using a developer comprising a toner and carrier particles is widely used to develop a latent electrostatic image in image forming apparatuses. This latent electrostatic image developing device has a development housing for accommodating a developer, a developer applicator means for applying the developer in the development housing to develop a latent electrostatic image, a developer agitating/conveying device for agitating the developer in the development housing and conveying it in a desired direction, and a toner feed means for supplying a toner into the development housing. The developer applicator means usually includes a rotating sleeve member on whose peripheral surface the developer is held to be conveyed to a developing zone. In the developing zone, a toner in the developer selectively adheres to a latent electrostatic image, whereby the latent image is developed to a toner image. When the toner in the developer has been consumed due to the development of latent electrostatic images, a toner is supplied by the toner feed means into the development housing. The developer agitating/conveying device agitates the developer within the development housing to mix and frictionally charge the toner and the carrier particles, and conveys the developer in a desired direction.

In the above-mentioned type of latent electrostatic image developing device, it is important that the developer be agitated sufficiently satisfactorily before being held on the developer applicator means and conveyed to the developing zone, and that the developer having its proportions of the toner and the carrier particles within a desired range with both components sufficiently uniformly mixed as the developer is applied to the latent electrostatic image. It is also important that downstream of the developing zone, the developer, having the proportion of the toner reduced as a result of the adhesion of the toner to the latent electrostatic image, be effectively released from the developer applicator means so as to be agitated and conveyed again within the development housing. To fulfill such requirements for agitating and conveying the developer, Japanese Utility Model Publication No. 27333/1975 and Japanese Laid-Open Patent Publication No. 260678/1991 disclose a developer agitating/conveying device composed of a first agitating/conveying member, extending adjacent to a developer applicator means, and a second agitating/conveying member, disposed upstream of the first agitating/conveying member.

The first agitating/conveying member comprises a rotating shaft extending in a widthwise direction (i.e. the axial direction of the rotating sleeve member in the developer applicator means), and a pair of helical blades formed at spaced apart locations in the axial direction on the rotating shaft and helically wound about the rotating shaft in directions opposite to each other. The second agitating/conveying member also comprises a rotating shaft extending in the widthwise direction, and a pair of helical blades formed at spaced apart locations in the axial direction on the rotating shaft and helically wound about the rotating shaft in directions opposite to each other. The first agitating/conveying member is rotated in a predetermined direction, conveys the developer from the opposite end portions in the axial direction toward the central portion in the axial direction while agitating it, and transfers the developer to the central portion in the axial direction of the second agitating/conveying member. The second agitating/conveying member rotated similarly in a predetermined direction conveys the developer from the central portion in the axial direction toward the opposite end portions in the axial direction while agitating it, and transfers the developer at the opposite end portions in the axial direction to the first agitating/conveying member. The developer conveyed by the second agitating/conveying member from the central portion in the axial direction toward the opposite end portions in the axial direction is held by the developer applicator means for conveyance to the developing zone.

A partition wall have a passageway in its widthwise central portion is disposed between the first agitating/conveying member and the second agitating/conveying member so that the developer conveyed by the first agitating/conveying member from the opposite end portions in the axial direction toward the central portion in the axial direction may be transferred to the second agitating/conveying member through the passageway provided in the widthwise central portion of the partition wall.

Japanese Laid-Open Patent Publication No. 260678/1991 further discloses that an inclined elliptic plate maybe disposed between the pair of helical blades on the rotating shaft of the second agitating/conveying member to distribute the developer, conveyed from one of the end portions to the central portion of the first agitating/conveying member, to both sides of the second agitating/conveying member, as well as to distribute the developer, conveyed from the other end portion to the central portion of the first agitating/conveying member, to both sides of the second agitating/conveying member, thereby ensuring the flow of the developer between one of the sides in the widthwise direction and the other side in the widthwise direction, and making the developer uniform throughout the widthwise direction.

However, the developer agitating/conveying device disclosed in Japanese Utility Model Publication No. 27333/1975 poses the problem that the developer in the right and left regions is circulated in the respective regions only, and no positive mixing of the developer in both regions takes place, with the result that the toner concentration of the developer in only one of the regions lowers. The developer agitating/conveying device disclosed in Japanese Laid-Open Patent Publication No. 260678/1991, on the other hand, is constructed such that the inclined elliptic plate is disposed between the pair of helical blades on the rotating shaft of the second agitating/conveying member to distribute the developer, conveyed from one of the end portions to the central portion of the first agitating/conveying member, to both sides of the second agitating/conveying member, thus permitting the toner concentration of the developer in the right and left regions to become uniform. As the inclined elliptic plate rotates, however, the force to agitate the developer works at right angles to the elliptic plate, thus making the clearance angle of the developer, and consequently promoting the deterioration of the developer, particularly, the carrier. When the carrier deteriorates, the capacity of the carrier to bear a charge declines, owing to the peeling of the coating on the surface of the carrier, deposition of fine toner particles, sites of contamination of the carrier surface by the toner material, and so on. Hence, the toner holding power of the carrier decreases. When the toner holding power of the carrier lowers, the charge characteristics of the toner do not stabilize, and physical changes occur, such as small charges, broad charge distribution, zero charges, and increases in reversely charged toner particles. As a result, inconveniences are caused, such as deposition of the toner on non-image areas (so-called toner fog), or toner scatter.

With the above-mentioned developer agitating/conveying device, moreover, as the flow of the developer decreases due to the deterioration of the developer carrier or environmental changes such as rise in humidity, the developer keeps staying near the central portion of the first agitating/conveying member which conveys the developer from the opposite end portions in the axial direction toward the central portion in the axial direction. Whereas the amount of the developer on the second agitating/conveying member side becomes scant. Thus, the circulation of the developer falls out of balance, causing inconveniences in the control of the toner concentration and the agitation and charge properties of the developer.

SUMMARY OF THE INVENTION

A first object of the present invention is to provide a developer agitating/conveying device in which the toner and the carrier particles in the right and left regions are thoroughly mixed, even when a latent electrostatic image having a toner adhesion region biased to one of the sides in the axial direction is developed, the mixing ratio of the toner and the carrier particles in the developer becoming nonuniform in the axial direction is fully prevented; such nonuniformity, if any, can be eliminated sufficiently rapidly; and the deterioration of the carrier can be suppressed.

A second object of the present invention is to provide a developer agitating/conveying device in which the developer can always be agitated and conveyed smoothly, without stagnating near the central portion of the agitating/conveying member for conveying the developer from the opposite end portions in the axial direction toward the central portion in the axial direction.

To attain the above first object, the present invention provides a developer agitating/conveying device comprising at least one partition wall disposed within a housing and having a developer transfer port at the central portion thereof, a first agitating/conveying member disposed along the partition wall on one side of the partition wall for conveying the developer from the opposite end portions toward the central portion thereof, the first agitating/conveying member having a first helical blade and a second helical blade helically wound in directions opposite to each other, and a second agitating/conveying member disposed along the partition wall on the other side of the partition wall for conveying the developer from the central portion toward the opposite end portions thereof, the second agitating/conveying member having a first helical blade and a second helical blade helically wound in directions opposite to each other, the first and second helical blades provided on the first agitating/conveying member and helically wound in directions opposite to each other being constructed such that their respective inner end half pitches overlap with a phase angle of 180 degrees relative to each other so as not to intersect each other.

To attain the above first object, the present invention also provides a developer agitating/conveying device comprising an upstream-side partition wall and a downstream-side partition wall disposed at spaced apart locations within a housing and each having a developer transfer port at the central portion thereof, a first agitating/conveying member disposed between the upstream-side partition wall and the downstream-side partition wall for conveying the developer from the opposite end portions toward the central portion thereof, the first agitating/conveying member having a first helical blade and a second helical blade helically wound in directions opposite to each other, a second agitating/conveying member disposed along the downstream-side partition wall on the downstream side of the downstream-side partition wall for conveying the developer from the central portion toward the opposite end portions thereof, the second agitating/conveying member having a first helical blade and a second helical blade helically wound in directions opposite to each other, and a third agitating/conveying member disposed along the upstream-side partition wall on the upstream side of the upstream-side partition wall for conveying the developer from the central portion toward the opposite end portions thereof, the third agitating/conveying member having a first helical blade and a second helical blade helically wound in directions opposite to each other, the first and second helical blades provided on the first agitating/conveying member and helically wound in directions opposite to each other being constructed such that their respective inner end half pitches overlap with a phase angle of 180 degrees relative to each other so as not to intersect each other.

In the developer agitating/conveying device for attaining the first object of the present invention, the developer conveyed by the first helical blade of the first agitating/conveying member toward the central portion in the axial direction, and the developer conveyed by the second helical blade of the first agitating/conveying member toward the central portion in the axial direction flow to the central portion along the inner end half pitch overlap between the first and second helical blades. In accordance with the rotation of the inner end half pitch overlap between the first and second helical blades, therefore, the developer conveyed by the first helical blade, and the developer conveyed by the second helical blade are conveyed alternately past the center in the axial direction. Hence, the developer conveyed from one of the regions by the first helical blade, and the developer conveyed from the other region by the second helical blade are mixed in nearly equal proportions, whereby the developer in the right and left regions is caused to be uniform. This way, the developer conveyed to the central portion in the axial direction of the first agitating/conveying member is transferred to the second agitating/conveying member side through the developer transfer port provided in the central portion of the partition wall, and then conveyed from the central portion toward the opposite end portions by the first and second helical blades of the second agitating/conveying member.

To attain the aforementioned second object, the present invention provides a developer agitating/conveying device comprising at least one partition wall disposed within a housing and having a developer transfer port at the central portion thereof, a first agitating/conveying member disposed along the partition wall on one side of the partition wall for conveying the developer from the opposite end portions toward the central portion thereof, the first agitating/conveying member having a first helical blade and a second helical blade, and a second agitating/conveying member disposed along the partition wall on the other side of the partition wall for conveying the developer from the central portion toward the opposite end portions thereof, the second agitating/conveying member having a first helical blade and a second helical blade, the opening edge of the developer transfer port provided in the partition wall being formed from parallel portions extending nearly parallel to each other in the up-and-down direction with a predetermined spacing until their upper end position reaches a position nearly corresponding to the initial height of the developer, with notched portions notched from the upper end position of the parallel portions toward the outer ends.

In the developer agitating/conveying device of the present invention, the developer conveyed to the central portion in the axial direction by the first helical blade of the first agitating/conveying member is transferred to the second agitating/conveying member side through the developer transfer port formed in the partition wall after being conveyed there. During this conveying process, the developer piled up with the risk of stagnating near the central portion of the first agitating/conveying member, owing to the decreased flowability of the developer due to the deteriorated developer carrier or environmental changes such as increased humidity, is transferred to the second agitating/conveying member side through the notched portions, which constitute the opening edge of the developer transfer port.

To attain the above second object, the present invention also provides a developer agitating/conveying device comprising an upstream-side partition wall and a downstream-side partition wall disposed at spaced apart locations within a housing and each having a developer transfer port at the central portion thereof, a first agitating/conveying member disposed between the upstream-side partition wall and the downstream-side partition wall for conveying the developer from the opposite end portions toward the central portion thereof, the first agitating/conveying member having a first helical blade and a second helical blade, a second agitating/conveying member disposed along the downstream-side partition wall on the downstream side of the downstream-side partition wall for conveying the developer from the central portion toward the opposite end portions thereof, the second agitating/conveying member having a first helical blade and a second helical blade, and a third agitating/conveying member disposed along the upstream-side partition wall on the upstream side of the upstream-side partition wall for conveying the developer from the central portion toward the opposite end portions thereof, the third agitating/conveying member having a first helical blade and a second helical blade, the opening edge of the developer transfer port provided in each of the upstream-side partition wall and the downstream-side partition wall being formed from parallel portions extending nearly parallel to each other in the up-and-down direction with a predetermined spacing until their upper end position reaches a position nearly corresponding to the initial height of the developer, and with notched portions notched from the upper end position of the parallel portions toward the outer ends.

In the developer agitating/conveying device of the present invention, the developer conveyed to the central portion in the axial direction by the first helical blade of the first agitating/conveying member is transferred to the second agitating/conveying member side and the third agitating/conveying member side through the developer transfer ports formed in the upstream-side and downstream-side partition walls after being conveyed there. During this conveying process, the developer piled up with the risk of stagnating near the central portion of the first agitating/conveying member, owing to the decreased flowability of the developer due to the deteriorated developer carrier or environmental changes such as increased humidity is transferred to the second agitating/conveying member side and the third agitating/conveying member side through the notched portions, which constitute the opening edge of each developer transfer port.

DETAILED DESCRIPTION OF THE PREFERRED EMBODIMENTS

The present invention will be described in more detail below with reference to the accompanying drawings, illustrating preferred embodiments of the developer agitating/conveying device constructed in accordance with the invention.

FIGS. 1 to 6 show a first embodiment of a developer agitating/conveying device constructed in accordance with the present invention.

Figure 1:
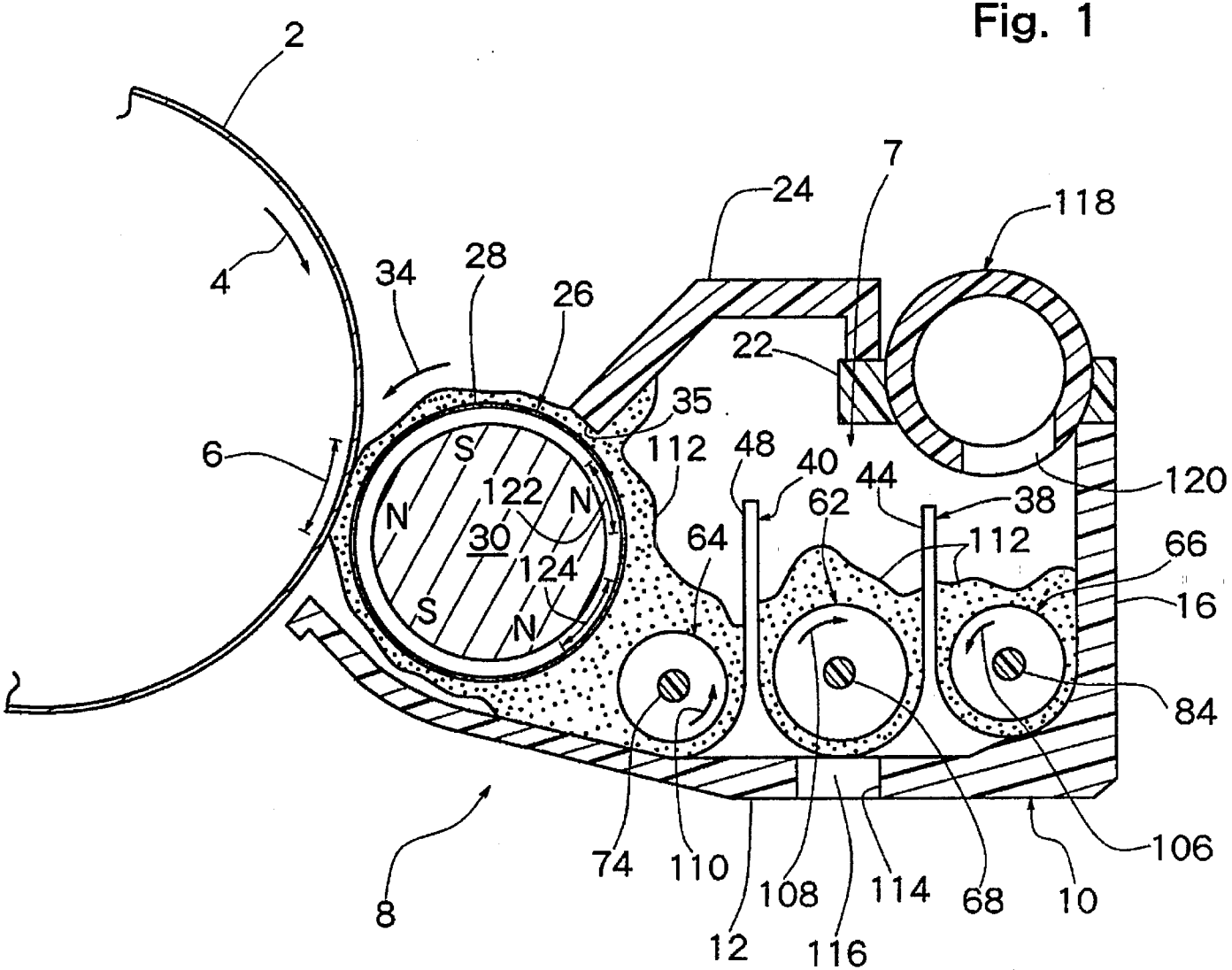
FIG. 1 is a sectional view showing an embodiment of a latent electrostatic image developing device equipped with a developer agitating/conveying device constructed in accordance with the present invention.

FIG. 1 shows a latent electrostatic image developing device equipped with a developer agitating/conveying device constructed in accordance with the present invention, along with part of a rotating drum constituting an electrostatic copying machine. A rotating drum 2 having a suitable electrostatic photosensitive material on its peripheral surface is adapted to be rotated in the direction of an arrow 4 to pass through a developing zone 6. Upstream of the developing zone 6, a latent electrostatic image is formed on the peripheral surface of the rotating drum 2 by a suitable method well known per se. In the developing zone 6, a latent electrostatic image developing device 8, equipped with a developer agitating/conveying device 7 constructed in accordance with the present invention, develops the latent electrostatic image on the peripheral surface of the rotating drum 2 to a toner image. Downstream of the developing zone 6, the toner image is transferred to a transfer member, such as a paper, and fixed there to obtain a copy or printed matter.

Figure 2:
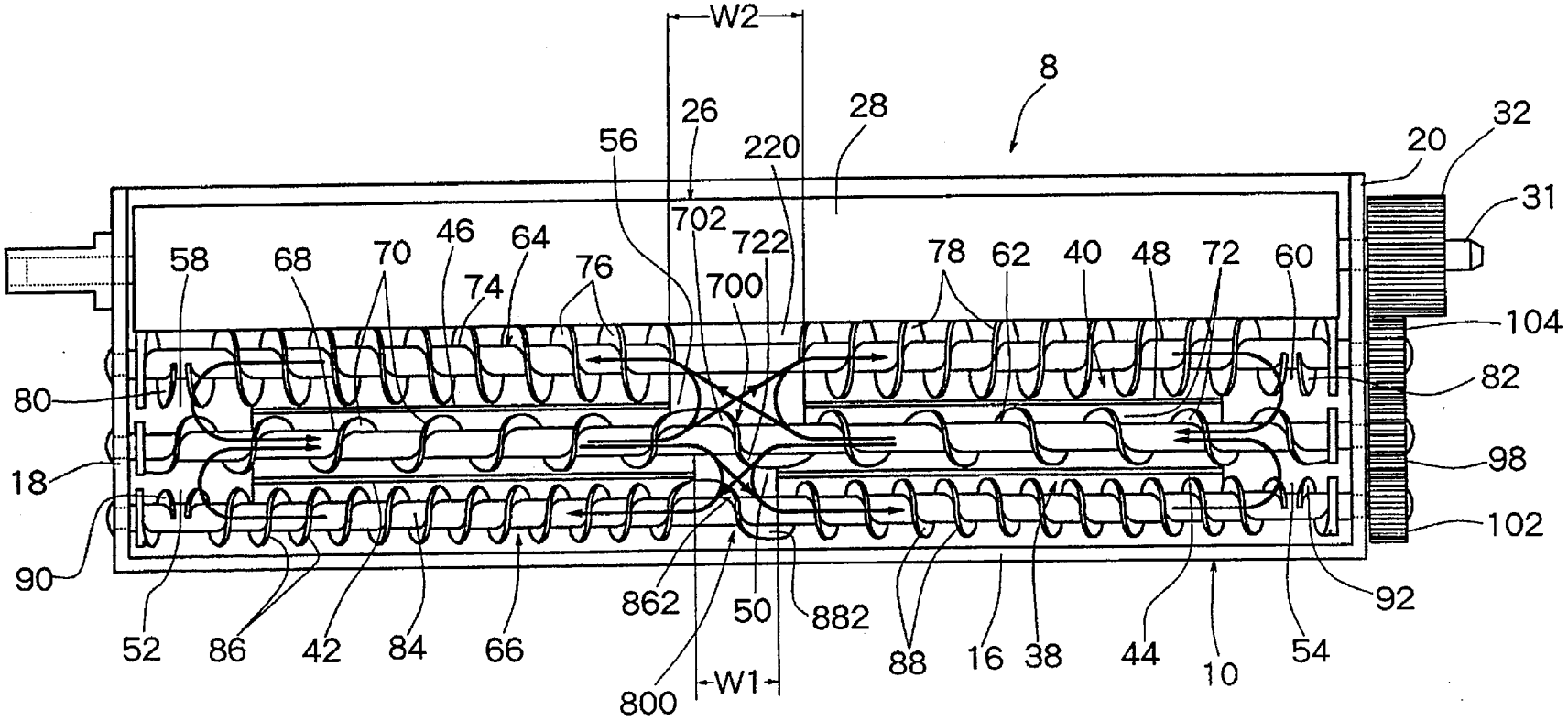
FIG. 2 is a plan view showing the latent electrostatic image developing device illustrated in FIG. 1, equipped with the developer agitating/conveying device constructed in accordance with the present invention, with the top wall of the development housing, the cover member, etc. being omitted.
Figure 3:
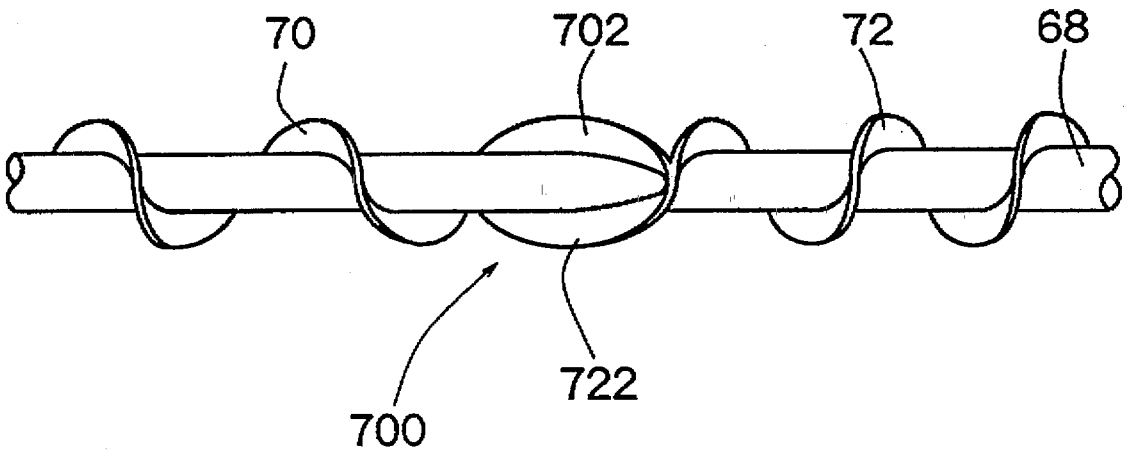
FIG. 3 is a fragmentary side view of the first agitating/conveying member of the developer agitating/conveying device illustrated in FIG. 1.

With reference to FIGS. 1 and 2, the latent electrostatic image developing device 8 has a development housing 10. The development housing 10, which may be molded from a suitable synthetic resin, includes a bottom wall 12, a rear wall 16 extending substantially vertically upwards from the rear side edge of the bottom wall 12, a front end wall 18, and a rear end wall 20. To the rear wall 16 is connected a top wall 22 projecting substantially horizontally forwards from the upper end of the rear wall 16. To the top wall 22 is further connected a cover wall 24

At a foremost portion of the development housing 10 (the leftmost portion in FIG. 1; the uppermost portion in FIG. 2) is disposed a developer applicator means 26. The developer applicator means 26 is constructed of a sleeve member 28 extending substantially horizontally in the widthwise direction, and a permanent magnet member 30 disposed within the sleeve member 28. The sleeve member 28 is formed of a non-magnetic material such as aluminum, and is mounted rotatably, while the permanent magnet member 30 is fixed at a predetermined position. As illustrated in FIG. 2, a rotating shaft 31 on which the sleeve member 28 is fixed protrudes rearwards through the rear end wall 20 of the development housing 10, and an input gear 32 is fixed to a protruding end portion of the shaft 31. The input gear 32 is drivingly connected to a rotary drive source (not shown), such as an electric motor, via an input gear (not shown) of the rotating drum 2 so as to be rotationally driven in the direction of an arrow 34. A free end 35 of the cover wall 24 for the development housing 10 is spaced a small distance from the peripheral surface of the sleeve member 28 of the developer applicator means 26. As will be described in further detail later, the free end 35 functions as a so-called tip cutting means for controlling the amount of the developer that is conveyed to the developing zone 6 while being held on the peripheral surface of the sleeve member 28.

The developer agitating/conveying device 7, constructed in accordance with the present invention, is disposed behind the developer applicator means 7. In the illustrated embodiment, the developer agitating/conveying device 7 has an upstream-side partition wall 38 and a downstream-side partition wall 40 disposed parallel to each other within the development having 10 and with a predetermined spacing therebetween in the back-and-forth direction (the right-and-left direction in FIG. 1, and the up-and-down direction in FIG. 2). The upstream-side partition wall 38 is defined by upright walls 42 and 44 protruding substantially vertically upwards from the bottom wall 12 of the development housing 10. Likewise, the downstream-side partition wall 40 is defined by upright walls 46 and 48 protruding substantially vertically upwards from the bottom wall 12 of the development housing 10. As will be clearly understood from FIG. 1, both side surfaces of the lower end portion of each of the upright walls 42, 44, 46 and 48 are in a concave arcuate form. As will be clearly understood by reference to FIG. 2, neither of the upright walls 42 and 44 is present at the central portion or the opposite end portions in the widthwise direction (the direction perpendicular to the sheet surface in FIG. 1, and the right-and-left direction in FIG. 2), but developer transfer ports 50 and 52, 54 are disposed at the central portion and the opposite end portions in the widthwise direction, respectively, of the upstream-side partition wall 38. Likewise, nether of the upright walls 46 and 48 is present at the central portion or the opposite end portions in the widthwise direction, but developer transfer ports 56 and 58, 60 are disposed at the central portion and the opposite end portions in the widthwise direction, respectively, of the downstream-side partition wall 40.

The dimension in the widthwise direction, W2, of the developer transfer port 56 provided at the central portion in the widthwise direction of the downstream-side partition wall 40 is greater than the dimension in the widthwise direction, W1, of the developer transfer port 50 provided at the central portion in the widthwise direction of the upstream-side partition wall 38. The relationship between these dimensions in the widthwise direction, W2 and W1, is determined by various factors such as the size of the device and the copying speed. According to our experiments, the dimension in the widthwise direction, W2, is preferably 1.3 to 4.0 times, more preferably 1.5 to 2.5 times, as large as the dimension in the widthwise direction, W1. The widthwise dimensions of the developer transfer ports 52 and 54 disposed at the opposite end portions in the widthwise direction of the upstream-side partition wall 38, and the developer transfer ports 58 and 60 disposed at the opposite end portions in the widthwise direction of the downstream-side partition wall 40 may all be substantially the same, and preferably are each nearly equal to the dimension in the widthwise direction, W2, of the developer transfer port 56 provided at the central portion in the widthwise direction of the downstream-side partition wall 40.

The illustrated developer agitating/conveying device 7 includes a first agitating/conveying member 62 disposed between the upstream-side partition wall 38 and the downstream-side partition wall 40, a second agitating/conveying member 64 disposed along the downstream-side partition wall 40 on the downstream side of (i.e. ahead of) the downstream-side partition wall 40, and a third agitating/conveying member 66 disposed along the upstream-side partition wall 38 on the upstream side of (i.e. behind) the upstream-side partition wall 38. The first agitating/conveying member 62, the second agitating/conveying member 64, and the third agitating/conveying member 66 are disposed in the same plane in the illustrated embodiment.

The first agitating/conveying member 62 has a rotating shaft 68 mounted rotatably between the opposite end walls 18 and 20 of the development housing 10. On the rotating shaft 68 are formed a pair of helical blades, a first helical blade 70 and a second helical blade 72, at spaced apart locations in the axial direction. The first helical blade 70 and the second helical blade 72 are constructed to have the same outside diameter and are opposite to each other in terms of the direction of helical winding. As clearly shown in FIGS. 2 to 4, the first helical blade 70 and the second helical blade 72 are constructed such that their respective inner end half pitches 702, 722 overlap with a phase angle of 180 degrees relative to each other so as not to intersect each other. The first and second helical blades 70, 72 are connected by an overlap 700 formed by their inner end half pitches 702 and 722. In the illustrated embodiment, the overlapping inner end half pitches 702, 722 of the first and second helical blades 70 and 72 are elongated in the axial direction. The so constructed first developer agitating/conveying member 62 is rotated in the direction of an arrow 108 in FIG. 1, and conveys the developer from the opposite end portions toward the central portion while agitating it.

Figure 4:
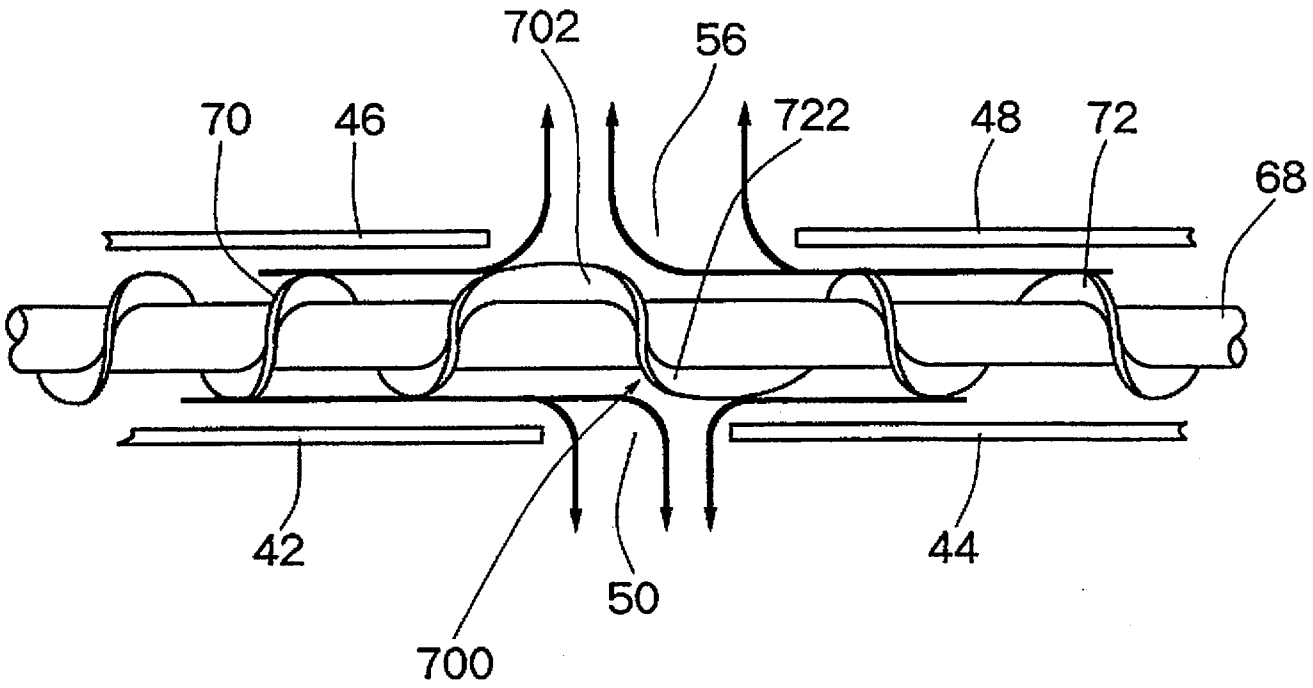
FIG. 4 is a fragmentary plan view showing the relationship between the first agitating/conveying member and the partition walls in the developer agitating/conveying device illustrated in FIG. 1.
Figure 5:
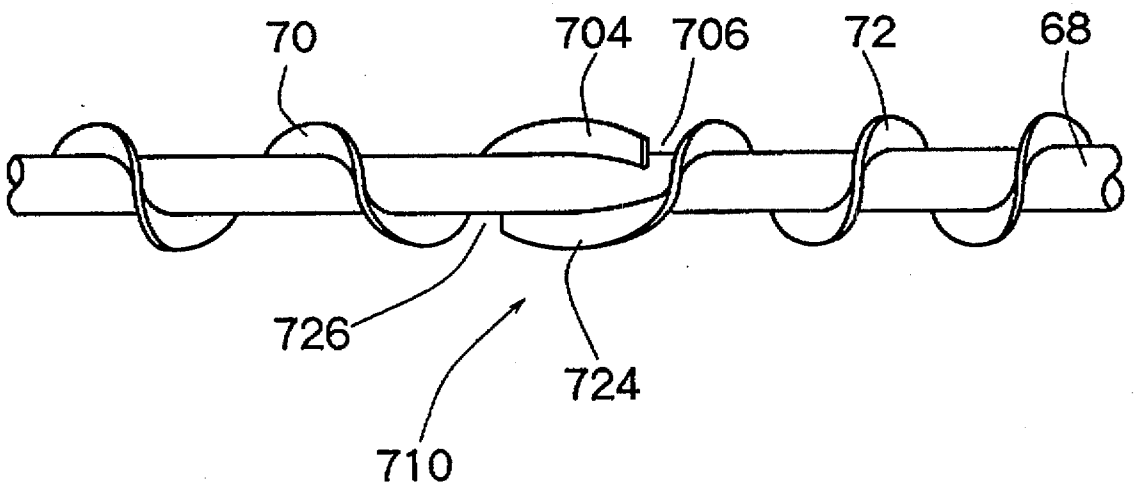
FIG. 5 is a fragmentary side view showing another embodiment of the first agitating/conveying member on the developer agitating/conveying device illustrated in FIG. 1.

Next, another embodiment of the first agitating/conveying member will be described with reference to FIG. 5. The agitating/conveying member according to this embodiment is identical with the first developer agitating/conveying member 62 shown in FIGS. 2 to 4, the only difference being in the structure of the inner end half pitches of the first and second helical blades 70 and 72 that are formed on the rotating shaft 68. Thus, the same portions have the same reference numerals, and their detailed descriptions are omitted. The agitating/conveying member following this embodiment has a gap 706 between the front end of the inner end half pitch 704 of the first helical blade 70 and the starting portion of the inner end half pitch 724 of the second helical blade 72, and also has a gap 726 between the front end of the inner end half pitch 724 of the second helical blade 72 and the starting portion of the inner end half pitch 704 of the first helical blade 70. The width of each of the gaps 706 and 726 may be about 3 mm. Providing these gaps 706 and 726 facilitates mold release when the agitating/conveying member has been molded from resin.

With reference to FIG. 2, the second agitating/conveying member 64 also has a rotating shaft 74 mounted rotatably between the opposite end walls 18 and 20 of the development housing 10. On the rotating shaft 74 are formed a pair of helical blades, a first helical blade 76 and a second helical blade 78, at spaced apart locations in the axial direction. The first helical blade 76 and the second helical blade 78 are constructed to have the same outside diameter and are opposite to each other in terms of the direction of helical winding. The inner end of the first helical blade 76 and the inner end of the second helical blade 78 are each disposed at a predetermined distance from the center in the axial direction of the second agitating/conveying member 64. At the central portion in the axial direction of the second agitating/conveying member 64, therefore, a mixing portion 220 is formed between the inner end of the first helical blade 76 and the inner end of the second helical blade 78. At opposite end portions of the rotating shaft 74 are formed a first auxiliary helical blade 80 and a second auxiliary helical blade 82 positioned so as to face the first helical blade 76 and the second helical blade 78, respectively. The outside diameters of the first and second auxiliary helical blades 80 and 82 may be the same as the outside diameters of the first and second helical blades 76 and 78. The directions of helical winding of the first and second auxiliary helical blades 80 and 82, extending over an angle of nearly 360 degrees, are opposite to the directions of helical winding of the respective first and second helical blades 76 and 78 that the auxiliary helical blades 80 and 82 face. The so constructed second developer agitating/conveying member 64 is rotated in the direction of an arrow 110 in FIG. 1, and conveys the developer from the central portion toward the opposite end portions thereof while agitating it.

With further reference to FIG. 2, the third agitating/conveying member 66 also has a rotating shaft 84 mounted rotatably between the opposite end walls 18 and 20 of the development housing 10. On the rotating shaft 84 are formed a pair of helical blades, a first helical blade 86 and a second helical blade 88, at spaced apart locations in the axial direction. The first helical blade 86 and the second helical blade 88 are constructed with the same outside diameter and are helically wound in opposite directions to each other. Inner end half pitches 862, 882 of the first and second helical blades 86, 88, like the inner end half pitches 702, 722 of the first and second helical blades 70, 72 provided in the first agitating/conveying member 62, are connected by an overlap 800 so as to overlap with a phase angle of 180 degrees relative to each other without intersecting each other. The overlapping inner end half pitches 862, 882 of the first and second helical blades 86 and 88, respectively, are elongated in the axial direction. The overlap 800 constituted by the inner end half pitches 862, 882 of the first and second helical blades 86, 88 may be of the same construction as the one illustrated in FIG. 5 for the second embodiment of the first agitating/conveying member. The outer end in the axial direction of each of the first and second helical blades 86 and 88 is advantageously located in correspondence with nearly the middle in the widthwise direction of each of the developer transfer ports 52 and 54 disposed at the opposite end portions in the widthwise direction of the upstream-side partition wall 38. At opposite end portions of the rotating shaft 84 are formed a first auxiliary helical blade 90 and a second auxiliary helical blade 92 positioned so as to face the first helical blade 86 and the second helical blade 88, respectively. The outside diameters of the first and second auxiliary helical blades 90 and 92 may be the same as the outside diameters of the first and second helical blades 86 and 88. The directions of helical winding of the first and second auxiliary helical blades 90 and 92 extending over with an angle of nearly 360 degrees, are opposite to the directions of helical winding of the respective first and second helical blades 86 and 88 that the auxiliary helical blades 90 and 92 face. The so constructed third developer agitating/conveying member 66 is rotated in the direction of an arrow 106 in FIG. 1, and conveys the developer from the central portion toward the opposite end portions while agitating it.

Figure 6:
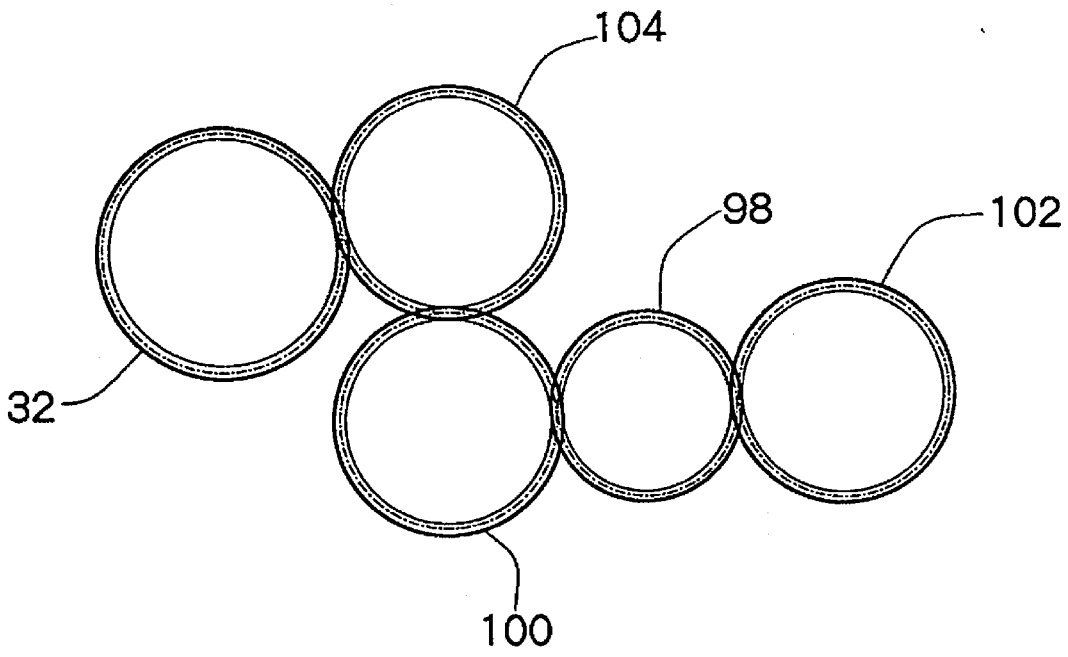
FIG. 6 is a schematic view showing the drivingly connected gears in the latent electrostatic image developing device illustrated in FIG. 1.

With reference to FIGS. 2 and 6, the rotating shaft 68 of the first agitating/conveying member 62, the rotating shaft 74 of the second agitating/conveying member 64, and the rotating shaft 84 of the third agitating/conveying member 66 each protrude rearwardly through the rear end wall 20 of the development housing 10. At the rear end portions of the rotating shafts 68, 74 and 84 are fixed input gears 98, 100 and 102, respectively. The input gear 102 is engaged with the input gear 98, the input gear 98 is engaged with the input gear 100, and the input gear 100 is engaged with the input gear 32 of the developer applicator means 26 via a transmission gear 104 mounted rotatably on the rear end wall 20. Therefore, when the sleeve member 28 of the developer applicator means 26 is rotated by the rotary drive source (not shown) in the direction of arrow 34, the first agitating/conveying member 62 is rotated in the direction of arrow 108, the second agitating/conveying member 64 is rotated in the direction of arrow 110, and the third agitating/conveying member 66 is rotated in the direction of arrow 106, as shown in FIG. 1.

As illustrated in FIG. 1, a developer 112, comprising a toner and carrier particles, is provided in the development housing 10. When housed there, the developer 112 is distributed suitably, i.e. on the side upstream of the upstream-side partition wall 38 (the right-hand side in FIG. 1, and the lower side in FIG. 2), between the upstream-side partition wall 38 and the downstream-side partition wall 40, and on the side downstream of the downstream-side partition wall 40 (the left-hand side in FIG. 1, and the upper side in FIG. 2). The third agitating/conveying member 66 when rotated in the direction of arrow 106 conveys the developer from the central portion in the axial direction toward the opposite end portions in the axial direction on the upstream side of the upstream-side partition wall 38 while agitating it. That is, the first helical blade 86 of the third agitating/conveying member 66 conveys the developer from the central portion in the axial direction toward one of the opposite end portions in the axial direction (the left end portion in FIG. 2) while agitating it, while the second helical blade 88 of the third agitating/conveying member 66 conveys the developer from the central portion in the axial direction toward the other end portion in the axial direction (the right end portion in FIG. 2) while agitating it. The first auxiliary helical blade 90 of the third agitating/conveying member 66 urges the developer inwards in the axial direction at one of the opposite end portions in the axial direction, while the second auxiliary helical blade 92 urges the developer inwards in the axial direction at the other end portion in the axial direction.

The first agitating/conveying member 62, being rotated in the direction of arrow 108, conveys the developer from the opposite end portions in the axial direction toward the central portion in the axial direction between the upstream-side partition wall 38 and the downstream-side partition wall 40 while agitating it. That is, the first helical blade 70 of the first agitating/conveying member 62 conveys the developer from one of the end portions in the axial direction (the left end portion in FIG. 2) toward the central portion in the axial direction while agitating it, whereas the second helical blade 72 of the first agitating/conveying member 62 conveys the developer from the other end portion in the axial direction (the right end portion in FIG. 2) toward the central portion in the axial direction while agitating it.

The second agitating/conveying member 64, being rotated in the direction of arrow 110, conveys the developer, while agitating it, from the central portion in the axial direction toward the opposite end portions in the axial direction on the downstream side of the downstream-side partition wall 40. That is, the first helical blade 76 of the second agitating/conveying member 64 conveys the developer from the central portion in the axial direction toward one of the end portions in the axial direction (the left end portion in FIG. 2) while agitating it, whereas the second helical blade 78 of the second agitating/conveying member 64 conveys the developer from the central portion in the axial direction toward the other end portion in the axial direction (the right end portion in FIG. 2) while agitating it. The first auxiliary helical blade 80 of the second agitating/conveying member 64 urges the developer inwards in the axial direction at one of the end portions in the axial direction, while the second auxiliary helical blade 82 urges the developer inwards in the axial direction at the other end portion in the axial direction.

It is important that the conveying capacity of the first agitating/conveying member 62, which conveys the developer from the opposite end portions in the axial direction to the central portion in the axial direction, be greater than the conveying capacity of each of the second agitating/conveying member 64 and the third agitating/conveying member 66, each conveying the developer from the central portion in the axial direction toward the opposite end portions in the axial direction. In order to bring the conveyance of the developer from the opposite end portions in the axial direction toward the central portion in the axial direction and the conveyance of the developer from the central portion in the axial direction toward the opposite end portions in the axial direction into substantial equilibrium, thereby distributing the developer sufficiently uniformly throughout the axial direction, it is preferred that the conveying capacity of the first agitating/conveying member 62 be nearly consistent with the sum of the conveying capacity of the second agitating/conveying member 64 and that of the third agitating/conveying member 66. Preferably, the conveying capacity of the second agitating/conveying member 64 is set to be larger than the conveying capacity of the third agitating/conveying member 66. Advantageously, the conveying capacity of the second agitating/conveying member 64 is about 1.2 to 2.5 times as high as the conveying capacity of the third agitating/conveying member 66 (the reasons will be explained later on). The conveying capacity of each of the first, second, and third agitating/conveying members 62, 64 and 66 can be set as desired by suitably setting the rotational speed, pitch, and outside diameter of each of their first and second helical blades 70 and 72, 76 and 78, and 86 and 88, respectively. In the illustrated embodiments, the number of revolutions per unit time of the second agitating/conveying member 64 and the number of revolutions per unit time of the third agitating/conveying member 66 are the same, while the number of revolutions per unit time of the first agitating/conveying member 62 is set to be greater than these. The pitch of the first and second helical blades 76 and 78 of the second agitating/conveying member 64 is greater than the pitch of the first and second helical blades 86 and 88 of the third agitating/conveying member 66, while the pitch of the first and second helical blades 70 and 72 of the first agitating/conveying member 62 is even greater than that of the first and second helical blades 76 and 78 of the second agitating/conveying member 64. The outside diameter of the first and second helical blades 86 and 88 of the third agitating/conveying member 66 is the same as the outside diameter of the first and second helical blades 76 and 78 of the second agitating/conveying member 64, whereas the outside diameter of the first and second helical blades 70 and 72 of the first agitating/conveying member 62 is greater than the outside diameter of the helical blades 86, 88, 76 and 78.

With reference to FIGS. 1 and 2, a circular opening 114 is formed at the site of the bottom wall 12 of the development housing 10 which is situated between the upstream-side partition wall 38 and the downstream-side partition wall 40 and at the central portion in the widthwise direction. In this opening 114 is disposed a detector 116 for detecting the concentration of the toner in the developer 112. The detector 116 may be one of a known type per se which can detect the toner concentration of the developer 112 by detecting the magnetic permeability of the developer 112 present on the top surface exposed within the development housing 10 through the opening 114. The latent electrostatic image developing device 8 is further provided with a toner feed means which is actuated depending on the toner concentration of the developer 112 detected by the detector 116. Such a toner feed means has a feeding pipe 118 disposed in the top wall 22 of the development housing 10. One end portion of the feeding pipe 118 is located above the central portion in the axial direction of the third agitating/conveying member 66, and a feed port 120 communicating with the inside of the development housing 10 is formed at the lowermost surface of the feeding pipe 118. The other end portion of the feeding pipe 118 which extends from the one end portion toward the front end in the widthwise direction is made to communicate with a toner receptacle (not shown), and a toner conveying means (not shown) constructible from a helical blade is disposed within the feeding pipe 118. When the toner concentration of the developer 112 detected by the detector 116 becomes less than a predetermined value, the toner conveying means in the feeding pipe 118 is actuated to convey toner from the toner receptacle via the feeding pipe 118. Then, the toner is caused to fall through the feed port 120 onto the central portion of the third agitating/conveying member 66 within the development housing 10. When the toner concentration detected by the detector 116 becomes the predetermined value or more, the actuation of the toner conveying means within the feeding pipe 118 is stopped to terminate the toner supply to the development housing 10.

The actions and effects of the latent electrostatic image developing device 8 equipped with the developer agitating/conveying device 7 as described above are summarized as follows: As indicated by the arrows in FIG. 2, the toner that falls through the feed port 120 formed in the feeding pipe 118 of the toner feed means is incorporated in the developer 112 within the development housing 10 after being evenly distributed on both sides from the central portion in the axial direction by the action of the overlap 800 between the inner end half pitches 862 and 882 of the first and second helical blades 86 and 88 of the third agitating/conveying member 66. The developer 112 present on the upstream side of the upstream-side partition wall 38 (the right-hand side in FIG. 1) is conveyed from the central portion in the axial direction toward the opposite end portions in the axial direction, while being agitated, by the action of the first and second helical blades 86 and 88 of the third agitating/conveying member 66. Since the conveying capacity of the third agitating/conveying member 66 is set to be relatively low, the developer 112 is conveyed at a relatively low speed from the central portion in the axial direction toward the opposite end portions in the axial direction by the third agitating/conveying member 66. During this motion, the developer 112 is fully agitated. The developer 112 conveyed to the opposite side portions in the axial direction by the third agitating/conveying member 66 is transferred forward through the developer transfer ports 52 and 54 disposed at the opposite side portions in the widthwise direction of the upstream-side partition wall 38, and introduced into the space between the upstream-side partition wall 38 and the downstream-side partition wall 40.

Then, in the space between the upstream-side partition wall 38 and the downstream-side partition wall 40, the developer 112 is conveyed, while being agitated, from the opposite side portions in the axial direction toward the central portion in the axial direction by the action of the first and second helical blades 70 and 72 of the first agitating/conveying member 62. The developer conveyed toward the central portion in the axial direction by the first helical blade 70 of the first agitating/conveying member 62, and the developer conveyed toward the central portion in the axial direction by the second helical blade 72 of the first agitating/conveying member 62 flow at the central portion along the overlap 700 constituted by the inner end half pitches 702 and 722 of the first and second helical blades 70 and 72, respective, as shown in FIG. 4. Thus, the developer conveyed by the first helical blade 70 and the developer conveyed by the second helical blade 72 are conveyed alternately beyond the center in the axial direction in accordance with the rotation of the overlap 700. Therefore, the developer conveyed from one region by the first helical blade 70, and the developer conveyed from the other region by the second helical blade 72 are mixed in nearly equal proportions, whereby the developer in the right region and that in the left region are made uniform. The developer thus mixed in nearly equal proportions from the right and left regions is transferred to the mixing portion 220 of the second agitating/conveying member 64 through the developer transfer port 56 provided at the central portion of the downstream-side partition wall 40. Part of this developer is transferred to the third agitating/conveying member 66 side through the developer transfer port 56 provided at the central portion of the upstream-side partition wall 38. Since the widthwise dimension W2 of the developer transfer port 56 formed in the downstream-side partition wall 40 is relatively large, a relatively large amount of the developer 112 is advanced to the downstream side of the downstream-side partition wall 40 through the developer transfer port 56. On the other hand, since the widthwise dimension W1 of the developer transfer port 50 formed in the upstream-side partition wall 38 is relatively small, the developer 112 returned to the upstream side of the upstream-side partition wall 38 through the developer transfer port 50 is a relatively small amount. Moreover, the toner that falls through the toner feed port 120 can be reliably prevented from being directly introduced into the space between the upstream-side partition wall 38 and the downstream-side partition wall 40 through the developer transfer port 50 without being conveyed, while under agitation, by the third agitating/conveying member 66.

The developer transferred forward through the developer transfer port 56, disposed at the central portion in the widthwise direction of the downstream-side partition wall 40, is conveyed from the central portion in the axial direction to the opposite side portions in the axial direction, while being agitated, by the action of the first and second helical blades 76 and 78 of the second agitating/conveying member 64. The developer 112 conveyed to the opposite side portions in the axial direction is transferred rearward through the developer transfer ports 58 and 60 disposed at the opposite side portions in the widthwise direction of the downstream-side partition wall 40, returned to the space between the upstream-side partition wall 38 and the downstream-side partition wall 40, and then conveyed from the opposite side portions in the axial direction toward the central portion in the axial direction, while being agitated, by the action of the first and second helical blades 70 and 72 of the first agitating/conveying member 62.

Referring to FIGS. 1 and 2, on the downstream side of the second agitating/conveying member 64 (the left-hand side in FIG. 1, and the upper side in FIG. 2), the sleeve member 28 of the developer applicator means 26 is rotated in the direction shown by the arrow 34. In a developer draw-up zone indicated at 122 in FIG. 1, the developer 112 being conveyed from the central portion in the axial direction toward the opposite side portions in the axial direction, while being agitated, by the first and second helical blades 76 and 78 of the second agitating/conveying member 64 is partly drawn up to the peripheral surface of the sleeve member 28 owing to a magnetic field formed by the stationary permanent magnet member 30. The developer 112 drawn up to the peripheral surface of the sleeve member 28 is conveyed in the direction of arrow 34 by the rotation of the sleeve member 28 for transportation to the developing zone 6. During this motion, excess developer 112 is removed from the peripheral surface of the sleeve member 28 by the action of the free end 35 of the cover wall 24 of the development housing 10. In the developing zone 6, as stated previously, the toner in the developer 112 is selectively attached to a latent electrostatic image formed on the peripheral surface of the rotating drum 4 to develop the latent electrostatic image to a toner image. In a developer peeling zone 124 located downstream of the developing zone 6, the developer 112 is released from the peripheral surface of the sleeve member 28 owing to the reduction of the magnetic field formed by the permanent magnet member 30 or for any other reason. Such developer 112 is decreased in toner concentration because of the consumption of the toner in the developing zone 6. The developer 112 released from the peripheral surface of the sleeve member 28 is incorporated in the developer 112 within the development housing 10 and conveyed toward the opposite side portions in the axial direction, while being agitated, by the first and second helical blades 76 and 78 of the second agitating/conveying member 64. Since the conveying capacity of the second agitating/conveying member 64 is set to be greater than the conveying capacity of the third agitating/conveying member 66, the developer 112 is fully satisfactorily released from the peripheral surface of the sleeve member 28 in the developer peeling zone 124, and such developer 112 is incorporated and agitated fully rapidly into the developer 112 accommodated in the development housing 10.

In the illustrated embodiment, three agitating/conveying members have been used, but two or more agitating/conveying members may be used to constitute the developer agitating/conveying device.

The developer agitating/conveying device according to the above embodiment is constituted in the above manner, in which the first and second helical blades provided on the first agitating/conveying member and helically wound in directions opposite to each other are constructed such that their respective inner end half pitches overlap with a phase angle of 180 degrees relative to each other so as not to intersect each other. Thus, the developer conveyed toward the central portion in the axial direction by the first helical blade of the first agitating/conveying member, and the developer conveyed toward the central portion in the axial direction by the second helical blade of the first agitating/conveying member flow at the central portion along the overlap constituted by the inner end half pitches of the first and second helical blades. Hence, the developer conveyed by the first helical blade and the developer conveyed by the second helical blade are conveyed alternately beyond the center in the axial direction in accordance with the rotation of the overlap between the inner end half pitches of the first and second helical blades. As a result, the developer conveyed from one region by the first helical blade, and the developer conveyed from the other region by the second helical blade are mixed in nearly equal proportions, whereby the developer in the right region and that in the left region are made uniform. Consequently, even when a latent electrostatic image having a toner adhesion region biased to one of the sides in the widthwise direction is developed, the mixing ratio of the toner and the carrier particles in the developer is fully prevented from becoming nonuniform. Even if the mixing ratio of the toner and the carrier particles becomes nonuniform in the widthwise direction, such nonuniformity can be eliminated sufficiently rapidly. Furthermore, the action of conveying the developer in one region past the center in the axial direction by the first helical blade of the first agitating/conveying member, and the action of conveying the developer in the other region past the center in the axial direction by the second helical blade are carried out by the flowing action along the overlap between the inner end half pitches of the first and second helical blades. Thus, there is no problem of increasing the deterioration of the developer, particularly, the carrier, as experienced with the conventional inclined elliptic plate. Moreover; the developer transferred from the central portion in the axial direction of the first agitating/conveying member to the second agitating/conveying member (and the third agitating/conveying member) is not forcibly urged in a different direction, as is done by the conventional inclined elliptic plate. Instead, it is conveyed smoothly as such from the central portion in the axial direction toward the opposite ends in the axial direction by the second agitating/conveying member (and the third agitating/conveying member). Hence, deterioration of the carrier is reduced, and the carrier can function satisfactorily for long periods.

Next, another embodiment of the developer agitating/conveying device constructed in accordance with the present invention will be described with reference to FIGS. 7 to 11.

FIGS. 1 and 6 in the aforementioned embodiment are substantially the same as in the instant embodiment. In the instant embodiment, therefore, drawings corresponding to FIGS. 1 and 6 will be omitted. However, FIGS. 1 and 6 will be referred to in offering the following description. The same members as in the embodiment illustrated in FIGS. 1 and 6 will be assigned the same reference numerals or signs, and their detailed explanation will be omitted.

Figure 7:
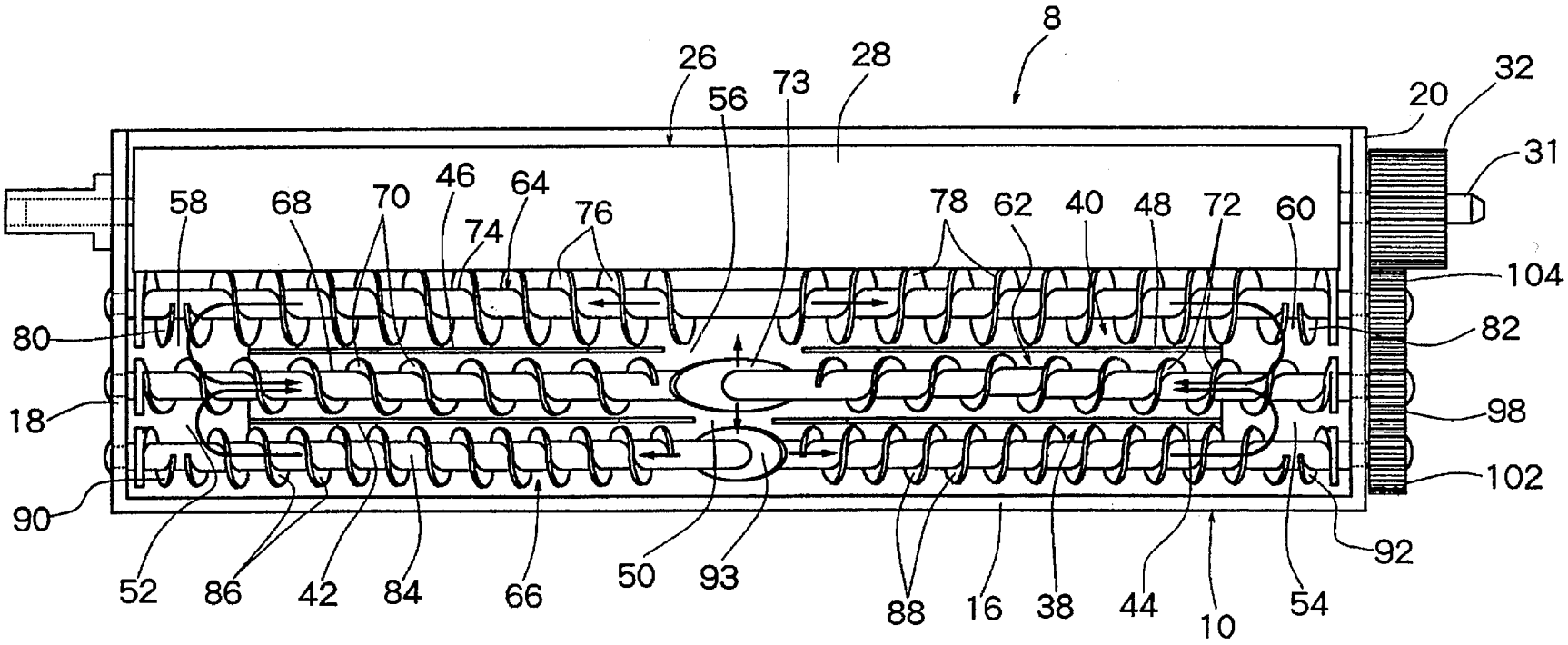
FIG. 7 is a plan view showing a latent electrostatic image developing device equipped with a developer agitating/conveying device according to another embodiment of the present invention, with the top wall of the development housing, the cover member, etc. being omitted.

A developer agitating/conveying device 7 in the instant embodiment has an upstream-side partition wall 38 and a downstream-side partition wall 40 disposed parallel to each other within the development housing 10 and a predetermined spacing therebetween in the back-and-forth direction (the right-and-left direction in FIG. 1, and the up-and-down direction in FIG. 7). The upstream-side partition wall 38 is defined by upright walls 42 and 44 protruding substantially vertically upwards from the bottom wall 12 of the development housing 8. Likewise, the downstream-side partition wall 40 is defined by upright walls 46 and 48 protruding substantially vertically upwards from the bottom wall 12 of the development housing 8. As will be clearly understood from FIG. 1, both side surfaces of the lower end portion of each of the upright walls 42, 44, 46 and 48 are in a concave arcuate form. As will be clearly understood by reference to FIG. 2, neither of the upright walls 42 and 44 is present at the central portion or the opposite end portions in the widthwise direction (the direction perpendicular to the sheet surface in FIG. 1, and the right-and-left direction in FIG. 7), but developer transfer ports 50 and 52, 54 are disposed at the central portion and the opposite end portions in the widthwise direction, respectively, of the upstream-side partition wall 38. Likewise, neither of the upright walls 46 and 48 is present at the central portion or the opposite end portions in the widthwise direction, but developer transfer ports 56 and 58, 60 are disposed at the central portion and the opposite end portions in the widthwise direction, respectively, of the downstream-side partition wall 40.

Figure 8:
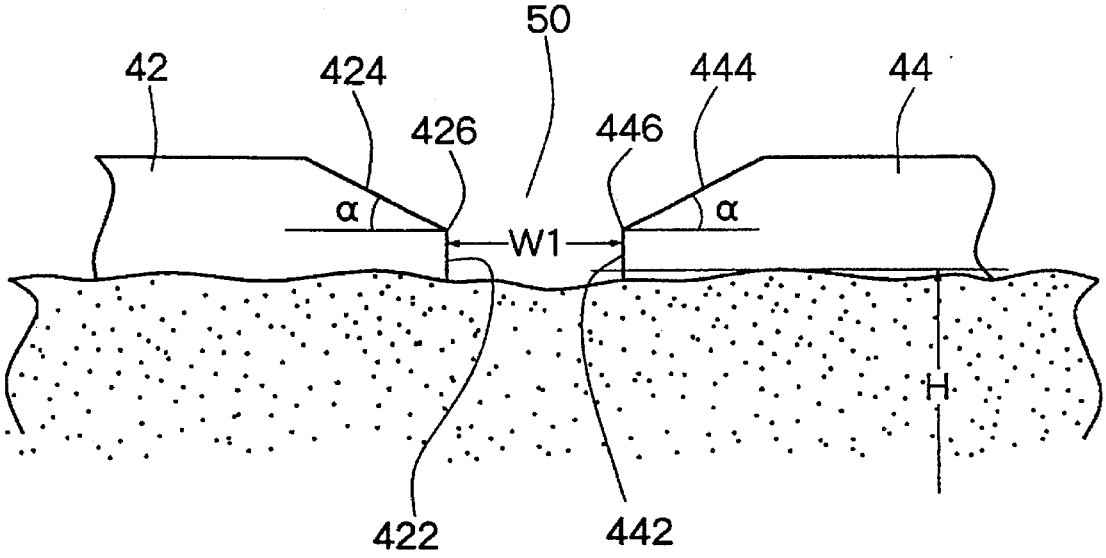
FIG. 8 is an explanatory drawing showing, on an enlarged scale, a developer transfer port formed in accordance with the present invention in an upstream-side partition wall in the developer agitating/conveying device of FIG. 7.

The developer transfer port 50 provided at the central portion in the widthwise direction of the upstream-side partition wall 38 is defined between the inner ends of the upright walls 42 and 44 constituting the upstream-side partition wall 38, as shown in FIG. 8. The opening edge of the developer transfer port 50 is formed of parallel portions 422, 442 extending nearly parallel to each other in the up-and-down direction with a predetermined spacing W1, and notched portions 424 and 444, notched inclinedly from the upper ends of the parallel portions 422, 442 toward the outer end portions. The upper ends of the parallel portions 422, 442, namely the starting points 426, 446 of the notched portions 424 and 444, are set at a position corresponding to, or slightly higher than, the initial height (H) of the developer. In the instant embodiment, they are set at a position about 5 mm higher than a position nearly corresponding to the initial height (H) of the developer. The initial height (H) of the developer as used herein refers to the height of the developer from the bottom surface of the development housing when the developer, which has not performed a developing action after the carrier and toner are initially mixed, is poured into the latent electrostatic image developing device, the developer agitating/conveying device is actuated, and the flow of the developer becomes stable. This initial height (H) of the developer does not vary greatly even when the developer is conveyed for circulation by an agitating/conveying member to be described. The notched portions 424 and 444 constituting the opening edge of the developer transfer port 50 each make an angle of inclination, $\alpha$, which should desirably be 45 degrees or less, and which is set at about 30 degrees in the instant embodiment. The height of the upright walls 42 and 44 constituting the upstream-side partition wall 38 depends on the flowability of the developer used, but needs to be set at a position about 5 mm higher than the starting points 426, 446 of the notched portions 424 and 444.

Figure 9:
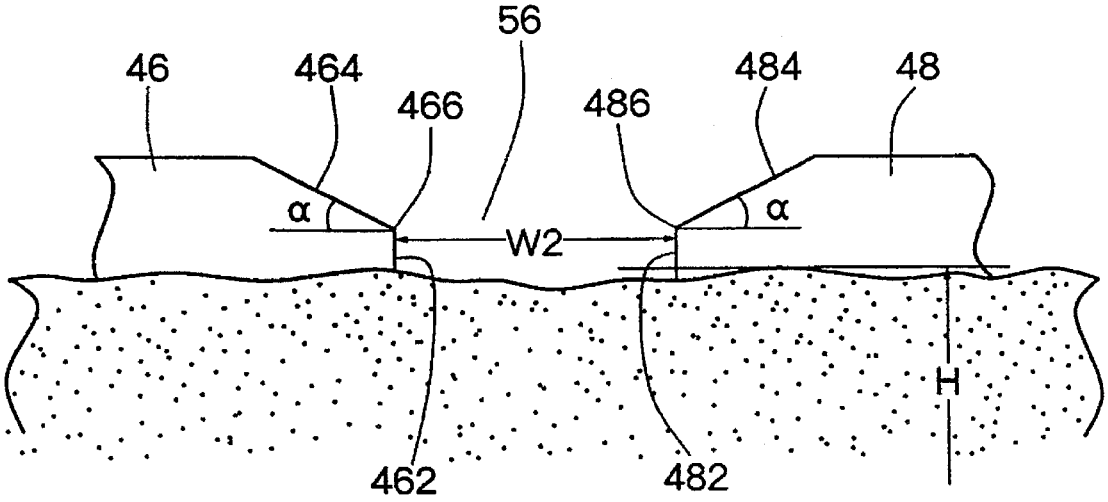
FIG. 9 is an explanatory drawing showing, on an enlarged scale, a developer transfer port formed in accordance with the present invention in a downstream-side partition wall in the developer agitating/conveying device of FIG. 7.

The developer transfer port 56 provided at the central portion in the widthwise direction of the downstream-side partition wall 40 is also defined between the inner ends of the upright walls 46 and 48 constituting the downstream-side partition wall 40, as shown in FIG. 9. The opening edge of the developer transfer port 56 is formed of parallel portions 462, 482 extending nearly parallel to each other in the up-and-down direction with a predetermined spacing W2, and notched portions 464 and 484 notched inclinedly from the upper ends of the parallel portions 462, 482 toward the outer end portions. In the instant embodiment, the upper ends of the parallel portions 462, 482, namely the starting points 466, 486 of the notched portions 464 and 484, are set at a position about 5 mm higher than a position corresponding to the initial height (H) of the developer. The height of the upright walls 42 and 44 constituting the upstream-side partition wall 38 is also set at a position about 5 mm higher than the starting points 466, 486 of the notched portions 464 and 484. The angle of inclination $\alpha$, of the notched portions 464 and 484 is set at about 30 degrees, as is the notched portions 424 and 444 constituting the opening edge of the developer transfer port 50 formed in the upstream-side partition wall 38. The spacing W2 between the parallel portions 462 and 482 constituting the opening edge of the developer transfer port 56 provided in the central portion in the widthwise direction of the downstream-side partition wall 40 is set to be greater than the spacing W1 between the parallel portions 422 and 442 constituting the opening edge of the developer transfer port 50 provided in the central portion in the widthwise direction of the upstream-side partition wall 38. If the spacing W2 is set to be nearly equal to the spacing W1, the developer will stagnate in the central portion. If the spacing W2 is far greater than the spacing W1, there will be lack of developer in the central portion. The relationship between the spacings W2 and W1 is determined by various factors such as the size of the device, copying speed, and so on. According to our experiments, the spacing W2 is preferably 1.3 to 4.0 times, more preferably 1.5 to 2.5 times, the spacing W1.

Figure 10:
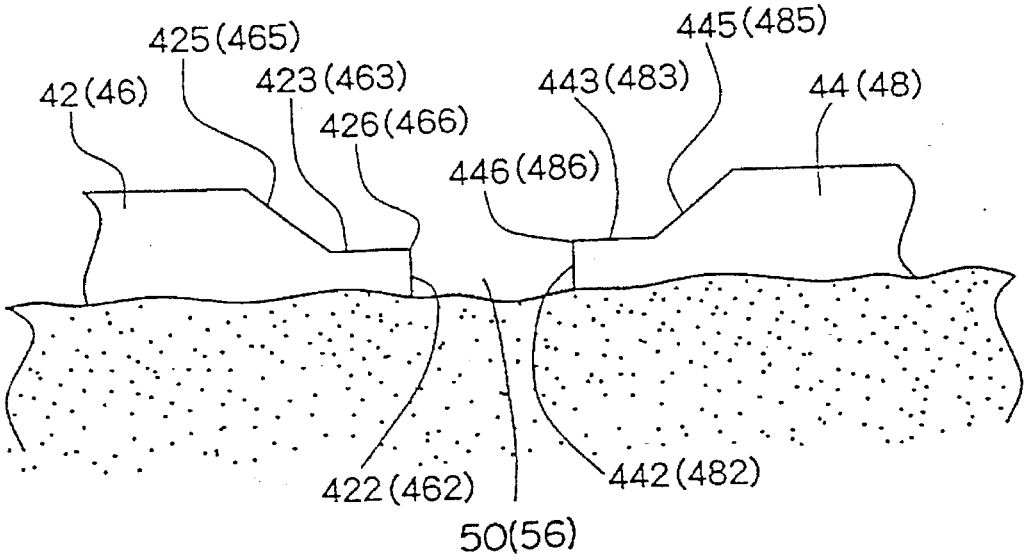
FIG. 10 is an explanatory drawing showing, on an enlarged scale, another embodiment of the developer transfer port formed in accordance with the present invention in each of the upstream-side partition wall and the downstream-side partition wall in the developer agitating/conveying device of FIG. 7.
Figure 11:
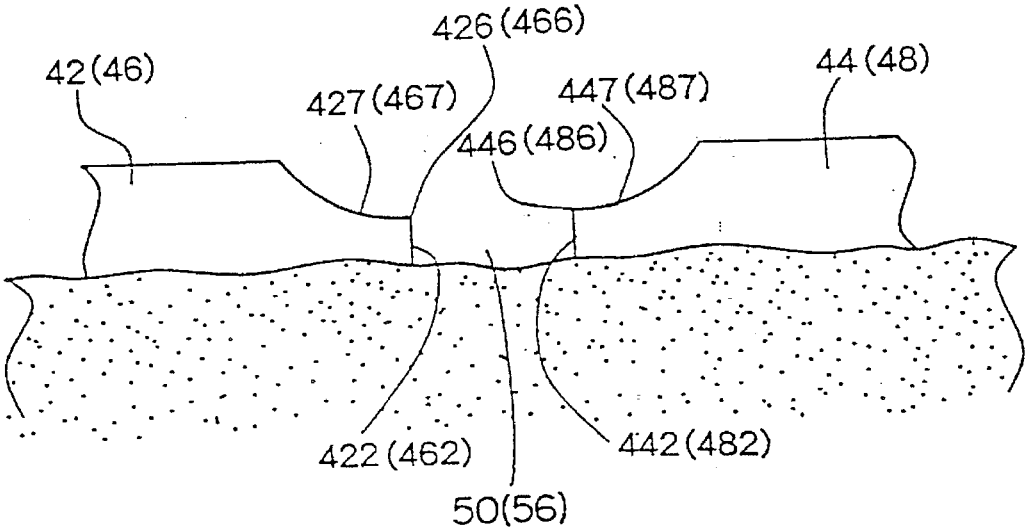
FIG. 11 is an explanatory drawing showing, on an enlarged scale, still another embodiment of the developer transfer port formed in each of the upstream-side partition wall and the downstream-side partition wall in accordance with the present invention in the developer agitating/conveying device of FIG. 7.

Next, other examples of the shape of the opening edges constituting the developer transfer ports 50 and 56 will be described with reference to FIGS. 10 and 11. The same members as in the embodiment shown in FIG. 8 will be assigned the same numerals or signs, and their explanations will be omitted. The developer transfer ports 50 and 56 are taken to have the same shape, with the numerals indicating the constituent elements of the developer transfer port 56 being enclosed in parentheses. In the embodiment shown in FIG. 10, the notched portions constituting the developer transfer port 50 (56) are constituted by horizontal portions 423 (463), 443 (483) extending from the upper ends of the parallel portions 422 (462), 442 (482), i.e., the starting points 426 (466) and 446 (486) of the notched portions toward the outer ends, and inclined portions 425 (465), 445 (485) inclined from the horizontal portions 423 (463), 443 (483) toward the outer ends. In the embodiment shown in FIG. 11, the notched portions constituting the developer transfer port 50 (56) are constituted by arcuate portions 427 (467), 447 (487) extending from the upper ends of the parallel portions 422 (462), 442 (482), i.e., the starting points 426 (466) and 466 (486) of the notched portions and toward the outer ends.

Returning to FIG. 7, the illustrated developer agitating/conveying device 7 includes a first agitating/conveying member 62 disposed between the upstream-side partition wall 38 and the downstream-side partition wall 40, a second agitating/conveying member 64 disposed along the downstream-side partition wall 40 on the downstream side of (i.e. ahead of) the downstream-side partition wall 40, and a third agitating/conveying member 66 disposed along the upstream-side partition wall 38 on the upstream side of (i.e. behind) the upstream-side partition wall 38. The first agitating/conveying member 62, the second agitating/conveying member 64, and the third agitating/conveying member 66 are disposed in the same plane in the illustrated embodiment.

The first agitating/conveying member 62 has a rotating shaft 68 mounted rotatably between the opposite end walls 18 and 20 of the development housing 10. On the rotating shaft 68 are formed a pair of helical blades, a first helical blade 70 and a second helical blade 72, at spaced apart locations in the widthwise direction (i.e. axial direction). The inner ends of the first helical blade 70 and the second helical blade 72 each do not reach the center in the axial direction of the first agitating/conveying member 62, and neither the first helical blade 70 nor the second helical blade 72 is provided at the central portion in the axial direction of the first agitating/conveying member 62. The first helical blade 70 and the second helical blade 72 are formed so as to be helically wound in directions opposite to each other. The outside diameter of the first helical blade 70 and that of the second helical blade 72 are the same. The so constructed first developer agitating/conveying member 62 is rotated in the direction of the arrow 108 in FIG. 1 and conveys the developer from the opposite end portions toward the central portion while agitating it.

An inclined elliptic plate 73 is provided at the central portion in the axial direction of the rotating shaft 68. The dimension in the axial direction of the inclined elliptic plate 73 is nearly the same as the spacing W2 between the parallel portions 462 and 482 constituting the developer transfer port 56 formed at the central portion in the widthwise direction of the downstream-side partition wall 40. The inclined elliptic plate 73 has a circular shape in its side view. The diameter of this circle is substantially the same as the outside diameter of each of the first and second helical blades 70 and 72.

The second agitating/conveying member 64 also has a rotating shaft 74 mounted rotatably between opposite end walls 18 and 20 of the development housing 10. On the rotating shaft 74 are formed a pair of helical blades, a first helical blade 76 and a second helical blade 78, at spaced apart locations in the widthwise direction (i.e. axial direction). The inner ends of the first helical blade 76 and the second helical blade 78 each do not reach the center in the axial direction of the second agitating/conveying member 64, and neither the first helical blade 76 nor the second helical blade 78 is provided at the central portion in the axial direction of the second agitating/conveying member 64. The inner ends of the first helical blade 76 and the second helical blade 78 provided in the second agitating/conveying member 64 are located inwardly of (i.e. nearer to the center in the axial direction) the inner ends of the first helical blade 70 and the second helical blade 72 provided in the first agitating/conveying member 62. The first helical blade 76 and the second helical blade 78 are formed so as to be helically wound in directions opposite to each other. The outside diameter of the first helical blade 76 and that of the second helical blade 78 are the same. The outer ends in the axial direction of the first helical blade 76 and the second helical blade 78 are advantageously positioned in correspondence with nearly the middle in the widthwise direction of the developer transfer ports 58 and 60, respectively, disposed at the opposite end portions in the widthwise direction of the downstream-side partition wall 40. At opposite end portions of the rotating shaft 74 are formed a first auxiliary helical blade 80 and a second auxiliary helical blade 82 positioned so as to face the first helical blade 76 and the second helical blade 78, respectively. The outside diameters of the first and second auxiliary helical blades 80 and 82 may be the same as the outside diameters of the first and second helical blades 76 and 78. The directions of helical winding of the first and second auxiliary helical blades 80 and 82, extending over an angle of nearly b 360degrees are opposite to the directions of helical winding of the respective first and second helical blades 76 and 78 that the auxiliary helical blades 80 and 82 face. The so constructed second developer agitating/conveying member 64 is rotated in the direction of an arrow 110 in FIG. 1, and conveys the developer from the central portion toward the opposite end portions thereof while agitating it.

With further reference to FIG. 7, the third agitating/conveying member 66 also has a rotating shaft 84 mounted rotatably between the opposite end walls 18 and 20 of the development housing 10. On the rotating shaft 84 are formed a pair of helical blades, a first helical blade 86 and a second helical blade 88, at spaced apart locations in the widthwise direction (axial direction). The inner ends of the first helical blade 86 and the second helical blade 88 each do not reach the center in the axial direction of the third agitating/conveying member 66, and neither the first helical blade 86 nor the second helical blade 88 is provided at the central portion in the axial direction of the third agitating/conveying member 66. The first helical blade 86 and the second helical blade 88 are formed so as to be helically wound in directions opposite to each other. The outside diameter of the first helical blade 86 and that of the second helical blade 88 are the same. The outer ends in the widthwise direction of the first helical blade 86 and the second helical blade 88 are advantageously positioned in correspondence with nearly the middle in the widthwise direction of the developer transfer ports 52 and 54, respectively, disposed at the opposite end portions in the widthwise direction of the upstream partition wall 38. At opposite end portions of the rotating shaft 84 are formed a first auxiliary helical blade 90 and a second auxiliary helical blade 92 positioned so as to face the first helical blade 86 and the second helical blade 88, respectively. The outside diameters of the first and second auxiliary helical blades 90 and 92 may be the same as the outside diameters of the first and second helical blades 86 and 88. The directions of helical winding of the first and second auxiliary helical blades 90 and 92, extending over with an angle of nearly 360 degrees, are opposite to the directions of helical winding of the respective first and second helical blades 86 and 88 that the auxiliary helical blades 90 and 92 face. The so constructed third developer agitating/conveying member 66 is rotated in the direction of an arrow 106 in FIG. 1, and conveys the developer from the central portion toward the opposite end portions while agitating it.

An inclined elliptic plate 93 is provided at the central portion in the axial direction of the rotating shaft 84. The dimension in the axial direction of the inclined elliptic plate 93 is nearly the same as the spacing W1 between the parallel portions 422 and 442 constituting the developer transfer port 50 formed at the central portion in the widthwise direction of the upstream-side partition wall 38. The inclined elliptic plate 93 has a circular shape in its side view, as does the inclined elliptic plate 73. The diameter of this circle is substantially the same as the outside diameter of each of the first and second helical blades 86 and 88.

With reference to FIGS. 6 and 7, as in the case of the above-mentioned embodiment, the rotating shaft 68 of the first agitating/conveying member 62, the rotating shaft 74 of the second agitating/conveying member 64, and the rotating shaft 84 of the third agitating/conveying member 66 each protrude rearwardly through the rear end wall 20 of the development housing 10. At the rear end portions of the rotating shafts 68, 74 and 84 are fixed input gears 98, 100 and 102, respectively. The input gear 102 is engaged with the input gear 98, the input gear 98 is engaged with the input gear 100, and the input gear 100 is engaged with the input gear 32 of the developer applicator means 26 via a transmission gear 104 mounted rotatably on the rear end wall 20. Therefore, when the sleeve member 28 of the developer applicator means 26 is rotated by the rotary drive source (not shown) in the direction of arrow 34, the first agitating/conveying member 62 is rotated in the direction of arrow 108, the second agitating/conveying member 64 is rotated in the direction of arrow 110, and the third agitating/conveying member 66 is rotated in the direction of arrow 106, as shown in FIG. 1.

In the instant embodiment, as in the case of the above-mentioned embodiment, a developer 112, comprising a toner and carrier particles, is provided in into the development housing 10, as illustrated in FIG. 1. When housed there, the developer 112 is distributed suitably, i.e. on the side upstream of the upstream-side partition wall 38 (the right-hand side in FIG. 1, and the lower side in FIG. 7), between the upstream-side partition wall 38 and the downstream-side partition wall 40, and on the side downstream of the downstream-side partition wall 40 (the left-hand side in FIG. 1, and the upper side in FIG. 7). The third agitating/conveying member 66 when rotated in the direction of arrow 106 conveys the developer from the central portion in the axial direction toward the opposite end portions in the axial direction on the upstream side of the upstream-side partition wall 38 while agitating it. That is, the first helical blade 86 of the third agitating/conveying member 66 conveys the developer from the central portion in the axial direction toward one of the opposite end portions in the axial direction (the left end portion in FIG. 7) while agitating it, while the second helical blade 88 of the third agitating/conveying member 66 conveys the developer from the central portion in the axial direction toward the other end portion in the widthwise direction (the right end portion in FIG. 7) while agitating it. The first auxiliary helical blade 90 of the third agitating/conveying member 66 urges the developer inwards in the axial direction at one of the opposite end portions in the widthwise direction, while the second auxiliary helical blade 92 urges the developer inwards in the axial direction at the other end portion in the axial direction.

The first agitating/conveying member 62 being rotated in the direction of arrow 108, conveys the developer from the opposite end portions in the axial direction toward the central portion in the axial direction between the upstream-side partition wall 38 and the downstream-side partition wall 40 while agitating it. That is, the first helical blade 70 of the first agitating/conveying member 62 conveys the developer from one of the end portions in the axial direction (the left end portion in FIG. 7) toward the central portion in the axial direction while agitating it, whereas the second helical blade 72 of the first agitating/conveying member 62 conveys the developer from the other end portion in the axial direction (the right end portion in FIG. 2) toward the central portion in the axial direction while agitating it.

The second agitating/conveying member 64, being rotated in the direction of arrow 110, conveys the developer, while agitating it, from the central portion in the axial direction toward the opposite end portions in the axial direction on the downstream side of the downstream-side partition wall 40. That is, the first helical blade 76 of the second agitating/conveying member 64 conveys the developer from the central portion in the axial direction toward one of the end portions in the axial direction (the left end portion in FIG. 7) while agitating it, whereas the second helical blade 78 of the second agitating/conveying member 64 conveys the developer from the central portion in the axial direction toward the other end portion in the axial direction (the right end portion in FIG. 7) while agitating it. The first auxiliary helical blade 80 of the second agitating/conveying member 64 urges the developer inwards in the axial direction at one of the end portions in the axial direction, while the second auxiliary helical blade 82 urges the developer inwards in the axial direction at the other end portion in the axial direction.

In the instant embodiment, as in the case of the aforementioned embodiment, it is important that the conveying capacity of the first agitating/conveying member 62, which conveys the developer from the opposite end portions in the axial direction to the central portion in the axial direction, be greater than the conveying capacity of each of the second agitating/conveying member 64 and the third agitating/conveying member 66, each conveying the developer from the central portion in the axial direction toward the opposite end portions in the axial direction. In order to bring the conveyance of the developer from the opposite end portions in the axial direction toward the central portion in the axial direction and the conveyance of the developer from the central portion in the axial direction toward the opposite end portions in the axial direction into substantial equilibrium, thereby distributing the developer sufficiently uniformly throughout the axial direction, it is preferred that the conveying capacity of the first agitating/conveying member 62 be nearly consistent with the sum of the conveying capacity of the second agitating/conveying member 64 and that of the third agitating/conveying member 66. Preferably, the conveying capacity of the second agitating/conveying member 64 is set to be larger than the conveying capacity of the third agitating/conveying member 66. Advantageously, the conveying capacity of the second agitating/conveying member 64 is about 1.2 to 2.5 times as high as the conveying capacity of the third agitating/conveying member 66. The conveying capacity of each of the first, second, and third agitating/conveying members 62, 64 and 66 can be set as desired by suitably setting the rotational speed, pitch, and outside diameter of each of their first and second helical blades 70 and 72, 76 and 78, and 86 and 88, respectively. In the illustrated embodiments, the number of revolutions per unit time of the second agitating/conveying member 64 and the number of revolutions per unit time of the third agitating/conveying member 66 are the same, while the number of revolutions per unit time of the first agitating/conveying member 62 is set to be greater than these. The pitch of the first and second helical blades 76 and 78 of the second agitating/conveying member 64 is greater than the pitch of the first and second helical blades 86 and 88 of the third agitating/conveying member 66, while the pitch of the first and second helical blades 70 and 72 of the first agitating/conveying member 62 is even greater than that of the first and second helical blades 76 and 78 of the second agitating/conveying member 64. The outside diameter of the first and second helical blades 86 and 88 of the third agitating/conveying member 66 is the same as the outside diameter of the first and second helical blades 76 and 78 of the second agitating/conveying member 64, whereas the outside diameter of the first and second helical blades 70 and 72 of the first agitating/conveying member 62 is greater than the outside diameter of the helical blades 86, 88, 76 and 78.

With reference to FIGS. 1 and 7, in the instant embodiment, as in the case of the aforementioned embodiment, a circular opening 114 is formed at the site of the bottom wall 12 of the development housing 10 which is situated between the upstream-side partition wall 38 and the downstream-side partition wall 40 and at the central portion in the widthwise direction. In this opening 114 is disposed a detector 116 for detecting the concentration of the toner in the developer 112. The latent electrostatic image developing device 8 is further provided with a toner feed means which is actuated depending on the toner concentration of the developer 112 detected by the detector 116. Such a toner feed means has a feeding pipe 118 disposed in the top wall 22 of the development housing 10. One end portion of the feeding pipe 118 is located above the central portion in the axial direction of the third agitating/conveying member 66, and a feed port 120 communicating with the inside of the development housing 10 is formed at the lowermost surface of the feeding pipe 118. The other end portion of the feeding pipe 118 which extends from the one end portion toward the front end in the widthwise direction is made to communicate with a toner receptacle (not shown), and a toner conveying means (not shown) constructible from a helical blade is disposed within the feeding pipe 118. When the toner concentration of the developer 112 detected by the detector 116 becomes less than a predetermined value, the toner conveying means in the feeding pipe 118 is actuated to convey toner from the toner receptacle via the feeding pipe 118. Then, the toner is caused to fall through the feed port 120 onto the inclined elliptic plate 93 of the third agitating/conveying member 66 within the development housing 10.

When the toner concentration detected by the detector 116 becomes the predetermined value or more, the actuation of the toner conveying means within the feeding pipe 118 is stopped to terminate the toner supply to the development housing 10.

The actions and effects of the latent electrostatic image developing device 8 equipped with the developer agitating/conveying device 7 as described above are summarized as follows: As indicated by the arrows in FIG. 7, the toner that falls through the feed port 120 formed in the feeding pipe 118 of the toner feed means is incorporated in the developer 112 within the development housing 10 after being evenly distributed on both sides from the central portion in the axial direction by the action of the inclined elliptic plate 93 of the third agitating/conveying member 66. The developer 112 present on the upstream side of the third upstream-side partition wall 38 (the right-hand side in FIG. 1) is conveyed from the central portion in the axial direction toward the opposite side portions in the axial direction, while being agitated, by the action of the first and second helical blades 86 and 88 of the third agitating/conveying member 66. Since the conveying capacity of the third agitating/conveying member 66 is set to be relatively low, the developer 112 is conveyed at a relatively low speed from the central portion in the axial direction toward the opposite side portions in the axial direction by the third agitating/conveying member 66. During this motion, the developer 112 is fully agitated. The developer 112 conveyed to the opposite side portions in the axial direction by the third agitating/conveying member 66 is transferred forward through the developer transfer ports 52 and 54 disposed at the opposite side portions in the widthwise direction of the upstream-side partition wall 38, and introduced into the space between the upstream-side partition wall 38 and the downstream-side partition wall 40.

Then, in the space between the upstream-side partition wall 38 and the downstream-side partition wall 40, the developer 112 is conveyed, while being agitated, from the opposite side portions in the axial direction toward the central portion in the axial direction by the action of the first and second helical blades 70 and 72 of the first agitating/conveying member 62. At the central portion in the axial direction of the first agitating/conveying member 62, part of the developer 112 is transferred forward through the developer transfer port 56, disposed at the central portion in the widthwise direction of the downstream partitioning means 38, while another part of the developer 112 is transferred rearward through the developer transfer port 50, disposed at the central portion in the widthwise direction of the upstream-side partition wall 40. During this motion, the action of the inclined elliptic plate 73 of the first agitating/conveying member 62 causes the developer 112 conveyed from one side in the axial direction to be suitably distributed on both sides in the axial direction, and the developer 112 conveyed from the other side in the axial direction to be suitably distributed on both sides in the axial direction. Since the spacing W2 between the parallel portions 462 and 482 constituting the developer transfer port 56 disposed at the central portion in the widthwise direction of the downstream-side partition wall 40 is set to be relatively large, a relatively large amount of the developer 112 is advanced to the downstream side of the downstream-side partition wall 40 through the developer transfer port 56. Since the spacing W1 between the parallel portions 422 and 442 constituting the developer transfer port 50 disposed at the central portion in the widthwise direction of the upstream-side partition wall 38 is set to be relatively small, the developer 112 returned to the upstream side of the upstream partitioning means 38 through the developer transfer port 50 is in a relatively small amount. Moreover, the toner that falls through the toner feed port 120 can be reliably prevented from being directly introduced into the space between the upstream partitioning means 38 and the downstream partitioning means 40 through the developer transfer port 50 without being conveyed, while under agitation, by the third agitating/conveying member 66. During this conveying process, the flowability of the developer may decrease owing to the deterioration of the developer carrier or environmental changes such as increased humidity. In such situations, the developer tends to stay near the central portion of the first agitating/conveying member 62 which conveys the developer from the opposite end portions in the axial direction toward the central portion in the axial direction. As a result, there will be insufficient amounts of the developer on the second agitating/conveying member 64 side and the third agitating/conveying member 66 side. Thus, the circulation of the developer will become unbalanced, causing difficulty in the control of the toner concentration. In the illustrated embodiment, the opening edges of the developer transfer ports 50 and 56 formed in the upstream-side partition wall 38 and the downstream-side partition wall 40 disposed on both sides of the first agitating/conveying member 62 are formed of parallel portions 422, 442 and 462, 482 extending nearly parallel to each other in the up-and-down direction with a predetermined spacing, and notched portions 424, 444 and 464, 484 notched inclinedly from the upper ends of the parallel portions 422, 442 and 462, 482 toward the outer end portions. Thus, the developer piled up with the risk of stagnating near the central portion of the first agitating/conveying member 62 is transferred to the third agitating/conveying member 66 side and the second agitating/conveying member 64 side through the notched portions 424, 444 and 464, 484. Therefore, the developer is caused to smoothly circulate without continuing to stay near the central portion of the first agitating/conveying member 62.

The developer transferred forward through the developer transfer port 56 disposed at the central portion in the widthwise direction of the downstream-side partition wall 40 is conveyed from the central portion in the axial direction to the opposite end portions in the axial direction, while being agitated, by the action of the first and second helical blades 76 and 78 of the second agitating/conveying member 64. The developer 112 conveyed to the opposite side portions in the axial direction is transferred rearward through the developer transfer ports 58 and 60 disposed at the opposite side portions in the widthwise direction of the downstream-side partition wall 40, returned to the space between the upstream-side partition wall 38 and the downstream-side partition wall 40, and then conveyed from the opposite side portions in the axial direction toward the central portion in the axial direction, while being agitated, by the action of the first and second helical blades 70 and 72 of the first agitating/conveying member 62.

Referring to FIGS. 1 and 7, on the downstream side of the third agitating/conveying member 64 (the left-hand side in FIG. 1, and the upper side in FIG. 7), the sleeve member 28 of the developer applicator means 26 is rotated in the direction shown by the arrow 34. In a developer draw-up zone indicated at 122 in FIG. 1, the developer 112 being conveyed from the central portion in the axial direction toward the opposite side portions in the axial direction, while being agitated, by the first and second helical blades 76 and 78 of the second agitating/conveying member 64 is partly drawn up to the peripheral surface of the sleeve member 28 owing to a magnetic field formed by the stationary permanent magnet member 30. The developer 112 drawn up to the peripheral surface of the sleeve member 28 is conveyed in the direction of arrow 34 by the rotation of the sleeve member 28 for transportation to the developing zone 6. During this motion, excess developer 112 is removed from the peripheral surface of the sleeve member 28 by the action of the free end 35 of the cover wall 24 of the development housing 10. In the developing zone 6, the toner in the developer 112 is selectively attached to a latent electrostatic image formed on the peripheral surface of the rotating drum 4 to develop the latent electrostatic image to a toner image. In a developer peeling zone 124 located downstream of the developing zone 6, the developer 112 is released from the peripheral surface of the sleeve member 28 owing to the reduction of the magnetic field formed by the permanent magnet member 30 or for any other reason. Such developer 112 is decreased in toner concentration because of the consumption of the toner in the developing zone 6. The developer 112 released from the peripheral surface of the sleeve member 28 is incorporated in the developer 112 within the development housing 10 and conveyed toward the opposite side portions in the axial direction, while being agitated, by the first and second helical blades 76 and 78 of the second agitating/conveying member 64. Since the conveying capacity of the second agitating/conveying member 64 is set to be greater than the conveying capacity of the third agitating/conveying member 66, the developer 112 is fully satisfactorily released from the peripheral surface of the sleeve member 28 in the developer peeling zone 124, and such developer 112 is incorporated and agitated fully rapidly into the developer 112 accommodated in the development housing 10.

In the illustrated embodiment, three agitating/conveying members have been used, but two or more agitating/conveying members may be used to constitute the developer agitating/conveying device.

The developer agitating/conveying device according to the above-described embodiment is constructed as noted above. The opening edge of the developer transfer port provided in the partition wall disposed between the first agitating/conveying member and the second agitating/conveying member (and the third agitating/conveying member) is formed from the parallel portions extending nearly parallel to each other in the up-and-down direction with a predetermined spacing until their upper end position reaches a position nearly corresponding to the initial height of the developer, and notched portions notched from the upper end position of the parallel portions toward the outer ends. Thus, the developer piled up with the risk of stagnating near the central portion of the first agitating/conveying member, owing to the decreased flowability of the developer associated with the deteriorated developer carrier or environmental changes such as increased humidity, is transferred to the second agitating/conveying member side through the notched portions constituting the opening edge of the developer transfer port. Hence, the developer is caused to smoothly circulate without continuing to stay near the central portion of the first agitating/conveying member, thus making it possible to maintain an appropriate toner concentration constantly.

What we claim is:

1. A developer agitating/conveying device for use with an image processing system, said developer agitating/conveying device comprising:

a housing, a partition wall disposed within the housing and having a developer transfer port at the central portion thereof, a first agitating/conveying member disposed along one side of the partition wall for conveying developer from opposite end portions of the housing toward the central portion thereof, the first agitating/conveying member having a first helical blade and a second helical blade helically wound in directions opposite to each other, and a second agitating/conveying member disposed along the other side of the partition wall for conveying the developer from the central portion of the housing toward the opposite end portions thereof, the second agitating/conveying member having a first helical blade and a second helical blade helically wound in directions opposite to each other, the first and second helical blades on the first agitating/conveying member having their respective inner end half pitches overlap with a phase angle of 180 degrees relative to each other so as not to intersect each other.

2. The developer agitating/conveying device of claim 1 wherein the overlapping inner end half pitches of the first and second helical blades on the first agitating/conveying member are elongated in the axial direction.

3. The developer agitating/conveying device of claim 1 wherein a first gap is provided between the front end of the inner end half pitch of the first helical blade on the first agitating/conveying member and a starting portion of the inner end half pitch of the second helical blade on the first agitating/conveying member, and a second gap is provided between the front end of the inner end half pitch of the second helical blade on the first agitating/conveying member and a starting portion of the inner end half pitch of the first helical blade on the first agitating/conveying member.

4. A developer agitating/conveying device for use with an image processing system, said developer agitating/conveying device comprising:

a housing, an upstream-side partition wall and a downstream side partition wall disposed at spaced apart locations within the housing, each partition wall having a developer transfer port at the central portion thereof, a first agitating/conveying member disposed between the upstream-side partition wall and the downstream-side partition wall for conveying developer from opposite end portions of the housing toward the central portion thereof, the first agitating/conveying member having a first helical blade and a second helical blade helically wound in directions opposite to each other, a second agitating/conveying member disposed along the downstream side of the downstream-side partition wall for conveying the developer from the central portion of the housing toward the opposite end portions thereof, the second agitating/conveying member having a first helical blade and a second helical blade helically wound in directions opposite to each other, and a third agitating/conveying member disposed along the upstream side of the upstream-side partition wall for conveying the developer from the central portion of the housing toward the opposite end portions thereof, the third agitating/conveying member having a first helical blade and a second helical blade helically wound in directions opposite to each other, the first and second helical blades on the first agitating/conveying member having their respective inner end half pitches overlap with a phase angle of 180 degrees relative to each other so as not to intersect each other.

5. The developer agitating/conveying device of claim 4 wherein the overlapping inner end half pitches of the first and second helical blades on the first agitating/conveying member are elongated in the axial direction.

6. The developer agitating/conveying device of claim 4 wherein a first gap is provided between the front end of the inner end half pitch of the first helical blade on the first agitating, conveying member and a starting portion of the inner end half pitch of the second helical blade on the first agitating/conveying member, and a second gap is provided between the front end of the inner end half pitch of the second helical blade on the first agitating/conveying member and a starting portion of the inner end half pitch of the first helical blade on the first agitating/conveying member.

7. The developer agitating/conveying device of claim 4 wherein the conveying capacity of the first agitating/conveying member is greater than the conveying capacity of the second agitating/conveying member and the conveying capacity of the third agitating/conveying member.

8. The developer agitating/conveying device of claim 4 wherein the conveying capacity of the first agitating/conveying member is substantially equal to the sum of the conveying capacity of the second agitating/conveying member and the conveying capacity of the third agitating/conveying member.

9. The developer agitating/conveying device of claim 4 wherein the conveying capacity of the second agitating/conveying member is greater than the conveying capacity of the third agitating/conveying member.

10. The developer agitating/conveying device of claim 4 wherein the dimension of the widthwise direction of the developer transfer port in the downstream-side partition wall is greater than the dimension in the widthwise direction of the developer transfer port in the upstream-side partition wall.

* * * * *